US005494285A

United States Patent [19]

Coldebella et al.

[11] Patent Number: 5,494,285

[45] Date of Patent: Feb. 27, 1996

[54] PINBALL PLAYFIELD ROLLER ASSEMBLY

[75] Inventors: Mark J. Coldebella, Palatine; Christopher A. Shipman, Chicago; Robert S. Morrison, Elgin, all of Ill.

[73] Assignee: Gamestar, Inc., Arlington Heights, Ill.

[21] Appl. No.: 392,539

[22] Filed: Feb. 23, 1995

[51] Int. Cl.[6] ..... A63F 7/36

[52] U.S. Cl. ..... 273/118 R; 273/119 R; 273/121 R; 312/325; 312/327; 312/323; 312/311; 312/313

[58] Field of Search ..... 273/118–121; 312/325, 327, 350, 351.1, 352, 322, 323, 310, 311, 313–315

[56] References Cited

U.S. PATENT DOCUMENTS

| | | | |
|---|---|---|---|
| 2,829,940 | 4/1958 | Stuck | 312/325 |
| 3,401,992 | 9/1968 | Benson et al. | 312/325 |
| 4,936,580 | 6/1990 | Kaminkow | 273/121 A |
| 5,193,807 | 3/1993 | Schilling et al. | 273/121 A X |

*Primary Examiner*—Raleigh Chiu

*Attorney, Agent, or Firm*—Robert E. Browne; Gary R. Jarosik

[57] ABSTRACT

A pinball machine is provided and includes a game cabinet having disposed therein a playfield movable between open, intermediate, and closed positions. A support assembly is used for maintaining the playfield within the cabinet. The support assembly includes a pair of cabinet brackets mounted one to each side of the cabinet where each of the brackets has a riding surface. A pair of wheels are mounted to the playfield and are provided to ride along the riding surface of a corresponding one of the cabinet brackets. A pair of support arms is further provided each having one end thereof pivotally attached to the cabinet and the other end thereof pivotally attached to the playfield wherein at least one of the support arms has pivotally attached thereto a prop arm which is engageable with the playfield when the playfield is disposed in the intermediate position.

21 Claims, 3 Drawing Sheets

PINBALL PLAYFIELD ROLLER ASSEMBLY

BACKGROUND OF THE INVENTION

This invention relates generally to pinball games and, more particularly, relates to a roller assembly for use in mounting a pinball playfield within a pinball cabinet.

Pinball games typically consist of an inclined playfield on which is disposed a plurality of play features such as targets, ramps, bumpers, or the like. Player controlled flippers are mounted on the playfield and are used by a player to direct a ball at selected play features to control game play and score points. The control components connecting, monitoring, and controlling the play features are usually disposed on the underside of the playfield. Therefore, the playfield must be freely mounted within the pinball cabinet whereby the playfield may be lifted in order to access the componentry for repair or maintenance.

Current mounting devices used to mount the playfield within the game cabinet, as exemplified in U.S. Pat. No. 5,193,807 to Schilling et al., comprise a pair of brackets mounted to the underside of the playfield, each engagable with a pivot stud mounted to either side of the game cabinet interior, and a hook piece used to connect the front of the playfield to the front of the game cabinet. Spring loaded latches are typically provided to further pivotally connect the ends of each bracket to the cabinet sides. To expose the underside of the playfield, the hook piece is disengaged and the playfield is slid forward on the studs until the spring loaded latches engage. Once the latches have engaged, the playfield may be pivoted back about the pivot studs so that the front of the playfield rests against the back cabinet to expose the underside thereof. To position the playfield in an intermediate position, a separate, unassociated prop arm is typically provided which is movable into engagement with the playfield for supporting the weight located at the front of the playfield.

While this system allows access to the underside of the playfield, the system is not "user friendly" in that the playfield typically binds on the studs, making movement thereof difficult, if not impossible, owing to the weight of the playfield. Furthermore, occasions arise where the spring loaded latches fail to properly engage thus preventing the secured pivoting of the playfield. In addition, should the prop arm not be utilized, the playfield may contact the front end of the game cabinet whereby the components mounted thereunder will become damaged. It has also been seen that, as currently employed playfield support mechanisms only support the front and rear of the playfield, it is required that the center of the playfield be supported by additional metal stripping attached thereto in order to prevent warping of the playfield surface. Such added material necessarily adds to the construction cost of the machine. It has been further seen that currently used mounting assemblies also make access to the components difficult in that, when the playfield is placed in the fully open position, the playfield becomes disposed at a position displaced from the front of the machine which is the location where service technicians typically have to stand in order to make repairs. For these reasons, a need exists for a pinball playfield mounting assembly which can easily and reliably be used to gain access to the components mounted under the playfield and which will also provide complete support to the playfield in an open position, a closed position, and an intermediate position.

As a result of these existing needs, it is an object of the present invention to provide a pinball playfield mounting assembly which will allow the user to easily and securely position the playfield in the desired open position.

It is another object of the present invention to provide a means for allowing the playfield to be opened along a predetermined fixed path where the components mounted thereunder are protected from being damage by contact with the playfield cabinet.

It is yet another object of the present invention to provide a pinball playfield mounting assembly which will secure the playfield within the cabinet when the playfield is in the closed position.

It is still another object of the present invention to provide a mechanism whereby the playfield may be securely propped open in the substantially vertical direction at a location near to the front of the playfield cabinet.

It is still a further object of the present invention to provide a mechanism which will support to the front, rear, and midsection of the playfield whereby warping of the playfield may be eliminated.

SUMMARY OF THE INVENTION

With these objects in view and in accordance with the present invention, a pinball machine is provided and includes a cabinet supporting a pair of cabinet brackets each having a riding surface and a playfield disposed within the cabinet and movable therein between an open, intermediate, and closed positions, where the playfield supports a pair of wheels each engagable with the riding surface of a corresponding one of the cabinet brackets. A pair of support arms is further provided each being pivotally linked to the cabinet at one end thereof and pivotally linked at the other end thereof to the playfield.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

Figure 1:
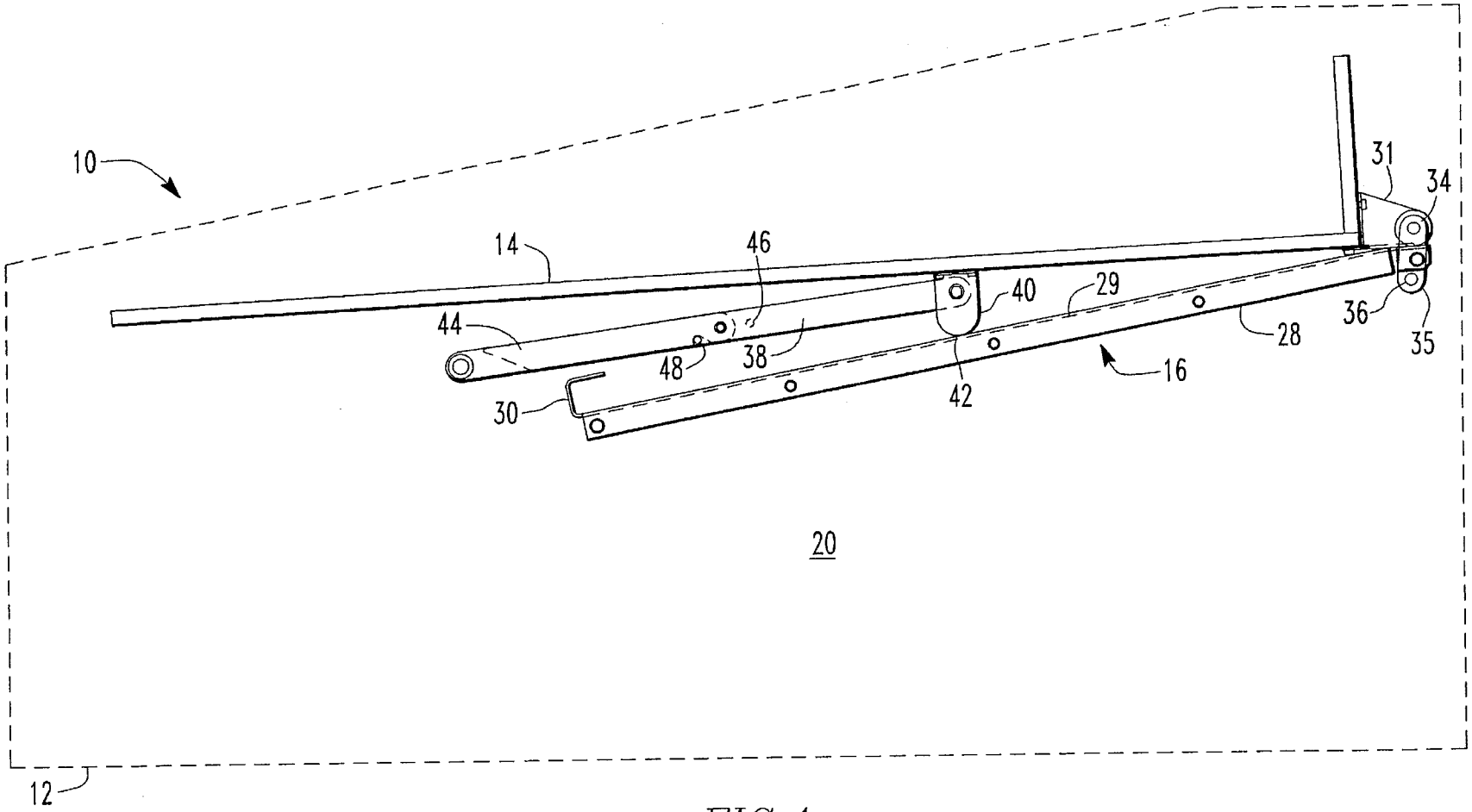
FIG. 1 illustrates the slide assembly of the present invention with the playfield positioned in the closed position.

While the invention can be used in a variety of amusement type devices it will be described hereinafter in the context of a pinball machine as the preferred embodiment thereof.

Referring now to the figures, wherein like reference numerals refer to like elements, there is shown generally a pinball game 10 which includes a playfield cabinet 12 in which is disposed a playfield 14. The playfield 14 is movably mounted within the playfield cabinet 12 as will be described in detail hereinafter. The playfield cabinet 12 includes a front portion and two oppositely disposed side portions 20. It is understood that the playfield 14 has mounted thereon the usual components associated with pinball play while the underside of the playfield contains the circuitry and hardware which is conventionally associated therewith.

Support of the playfield 12 within the playfield cabinet 14 is provided by a pair of playfield roller assemblies 16 and a conventional front latch mechanism. The front latch mechanism (not illustrated) consists of a generally "L" shaped hook or catch which is attached to the front of the playfield 14. Correspondingly, the front portion of the playfield cabinet is provided with a shelf or bracket having an opening or slot into which the catch may be removably seated. The front latch mechanism is used to support the front end of the playfield 14 when the playfield 14 is in the closed or play position.

Each of the playfield roller assemblies 16 includes a generally "L" shaped bracket 28, having a mounting surface and a riding surface 29, which is mounted one to each side 20 of the playfield cabinet 12. The brackets 28 may be mounted conventionally through the use of screws or the like and are preferably positioned with an incline towards the front portion of the playfield cabinet 12 with the mounting surface flush against the cabinet side 20 and the riding surface 29 extending inward therefrom. Positioned at the end of the brackets 28 proximate to the front portion of the cabinet 12 is a stop 30. The stop 30 preferably comprises a portion of the riding surface 29 bent into a rearwardly opening, generally "U" shaped section.

Attached to the playfield 14 proximate to the rear thereof are a pair of brackets 31 which each has rotatably mounted thereon a wheel 34. Each of the wheels 34 are positioned on the corresponding bracket 31 to engage the riding surface 29 of the corresponding one of the brackets 28. Furthermore, an optional catch assembly 35 may be pivotally attached to each of the brackets 31. Each catch assembly 35 includes a post 36 which extends outwardly to a position under the riding surface 29 of the bracket 28.

Further attached to the underside of the playfield 14 is a pair of support arms 38. Each of the support arms 38 is attached to the underside of the playfield 14, between the front thereof and the rear thereof, by being pivotally attached to a bracket 40 which extends downwardly therefrom. Preferably, the bracket 40 has an arcuate surface 42 which is positioned on the bracket 40 to engage the riding surface 29 of the corresponding one of the brackets 28 when the playfield 14 is positioned in the closed position. The opposite end of the support arm 38 is pivotally connected to the side 20 of the playfield cabinet 12.

Preferably, at least one of the support arms 38 is equipped with a prop arm 44 which is pivotally attached to the support arm 38. The support arm 38 which carries the prop arm 44 is further equipped with a first post 46 and a second post 48 which both extend inwardly therefrom. The first post 46 functions to restrict the rotational movement of the prop arm 44 in one direction (clockwise as viewed in the figures) while the second post 48 functions to restrict rotational movement of the prop arm 44 in the opposite direction. The prop arm 44 may also be equipped with a notch 50 which is cooperable with the second post 48. Preferably, the prop arm 44 is provided with an angular surface 52 which is engageable with the underside of the playfield 14 as will be described hereinafter.

As shown in FIG. 1, when the playfield 14 is positioned in the closed position, the rear portion of the playfield 14 is supported by the engagement of the wheels 34 with the riding surface 29 of each of the brackets 28. Furthermore, the center portion of the playfield 14 is supported by the engagement between each of the brackets 40 and the riding surface 29 of each of the brackets 28. As discussed previously, the front of the playfield is supported by the conventionally used "L" shaped catch. In the closed position, the optional catch 35 prevents upward movement of the rear of the playfield 14 as such movement is limited by the engagement between the pin 36 and the underside of the riding surface 29. Furthermore, rearward motion of the playfield 14 is prevented by the engagement of the support arm 38 between the side 20 of the cabinet 12 and the playfield 14 itself.

Figure 2:
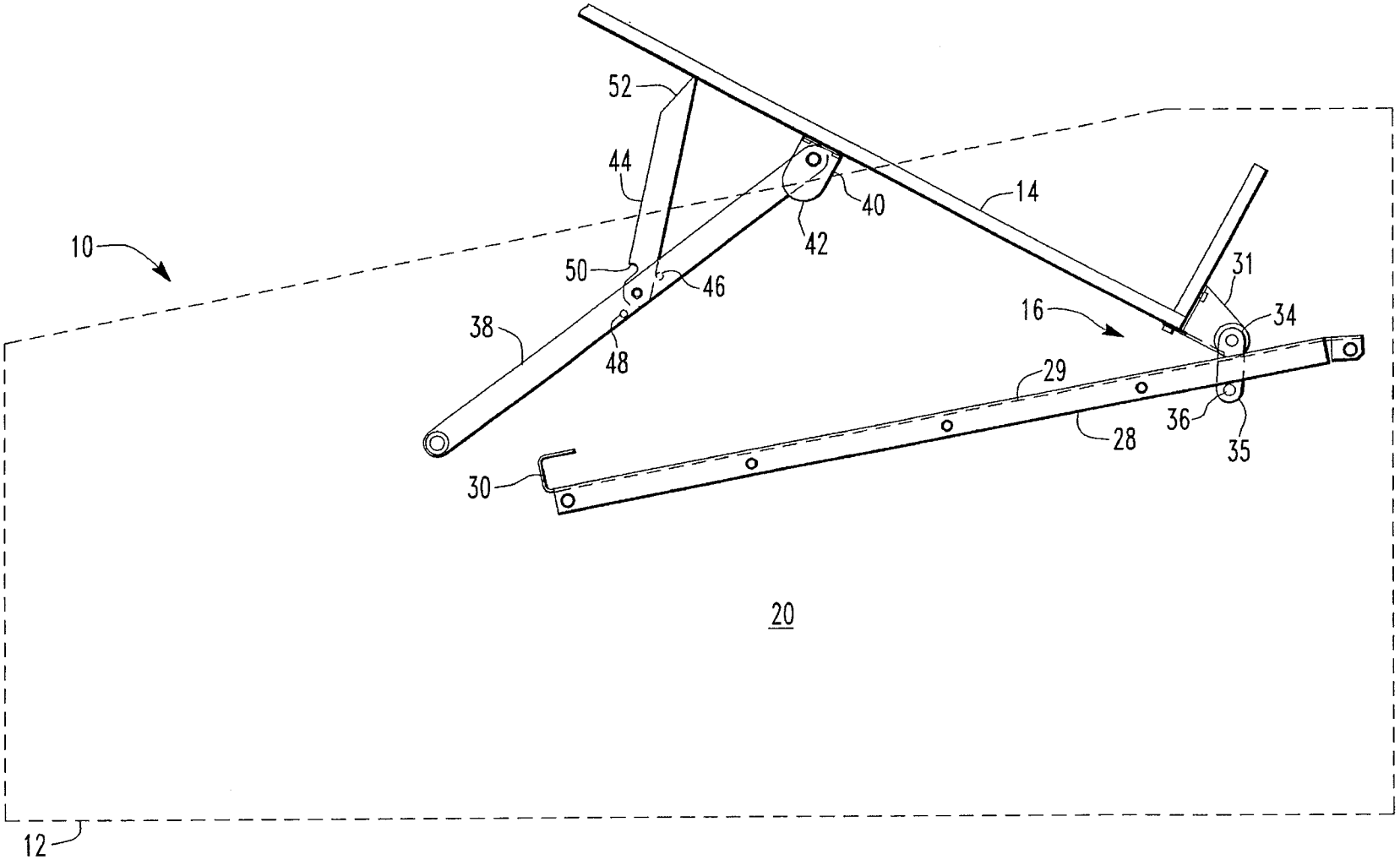
FIG. 2 illustrates the slide assembly of the present invention with the playfield positioned in an intermediate position.

To move the playfield 14 from the closed position to the open position, first the front of the playfield 14 is freed from the engagement between the "L" catch and the associated holding bracket. Thereafter, the front of the playfield 14 is generally lifted and moved rearward. During this movement from the fully closed position, the rear portion of the playfield 14 continues to be supported by the engagement between the wheels 34 and the riding surface 29 as the wheels 34 progress down the incline of the bracket 28. As seen in FIG. 2, during movement from the fully closed position, the support arm 38 engages the bracket 40 as the bracket 40 follows the playfield 14 downward. During this movement, the support arm 38 carries the load of the center portion of the playfield 14.

Once an intermediate position is obtained, the prop arm 44 may be freed from its engagement with the post or peg 48 and swung upward to engage the underside of the playfield 14. In the intermediate position, best illustrated in FIG. 2, the rear portion of the playfield 14 is supported by the engagement between the wheels 34 and the riding surfaces 29. The center portion of the playfield 14 is supported by the engagement with the prop arm 44 and by the support arm 38. Furthermore, the first peg 46 functions in this position to prevent the prop arm 46 from slipping rearwardly whereby the support provided thereby would be lost. The playfield 14 may also be equipped with an optional opening into which the prop arm 44 may be positioned which will aid in the engagement therebetween. In the intermediate position, the playfield 14 is effectively locked against downward movement. Therefore, to lower the playfield 14 from this position, the prop arm 44 must be returned to its orignal position and the playfield 14 pushed downward to cause the wheels 34 to move up the incline of the support brackets 28.

Figure 3:
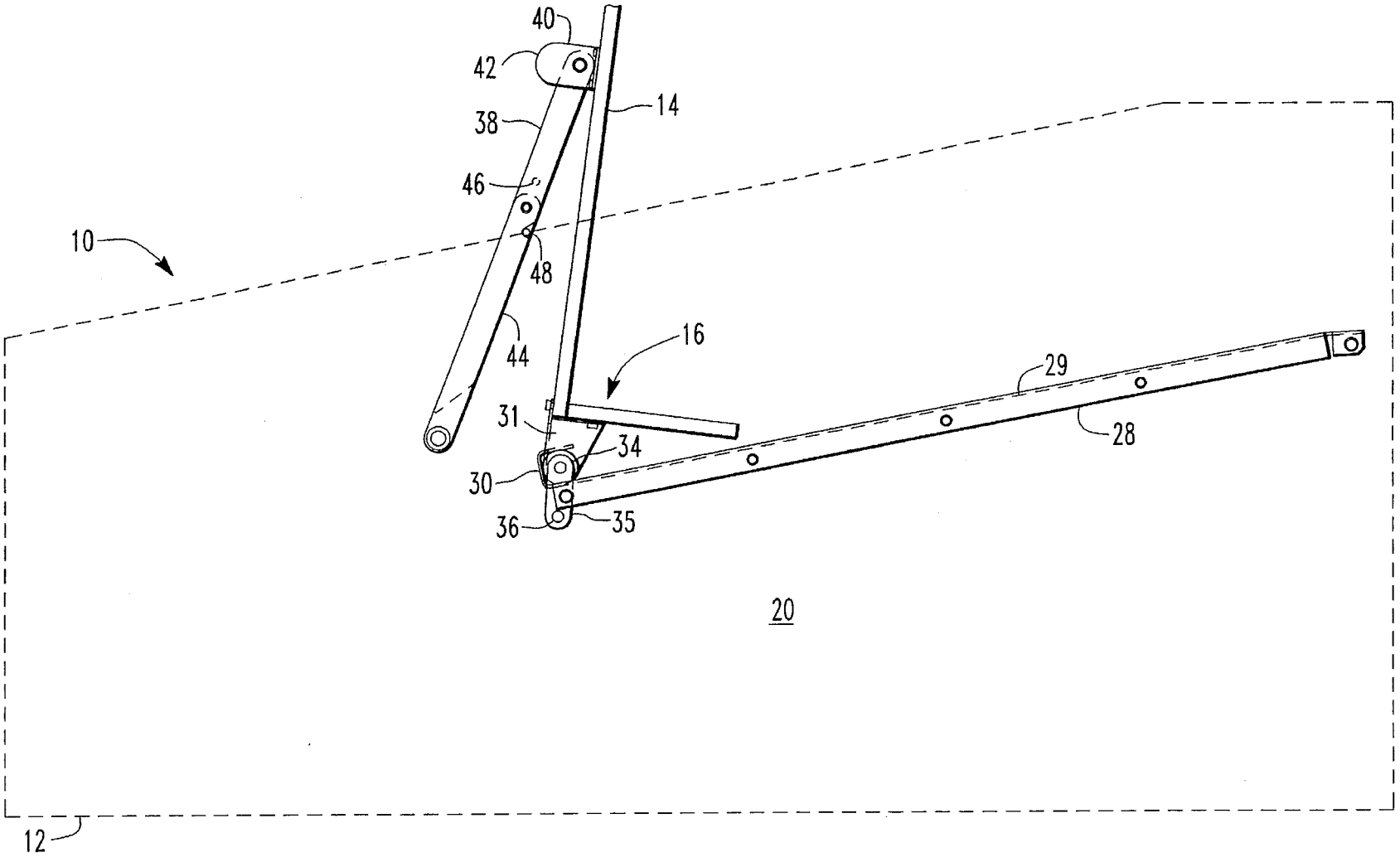
FIG. 3 illustrates the slide assembly of the present invention with the playfield positioned in the open position.

From the intermediate position, if the playfield is continued to be lifted, the prop arm 44, owing to its length, will lose engagement with the underside of the playfield 14 and will be caused by the peg 46 moving thereagainst, and gravity, to swing back into its closed position signified by its engagement with the peg 4S. Upward movement of the playfield 14 may continue until the wheels 34 become trapped in the generally "U" shaped stops 30 whereby the fully open position is achieved, best seen in FIG. 3.

In the fully open position, the playfield 14 is seen to be supported by the engagement between the wheels 34 and the riding surface 29. The support arms 38 function to prevent further rotational movement of the playfield 14 about the wheels 34 and, therefore, maintains the playfield 14 in a generally vertical orientation at a location removed from the rear of the cabinet. In the fully open position, the optional catch 35 may be rotated about the stop 30 such that the pin 36 will now be disposed above the riding surface 29. If the pin 36 maintains this non-contacting relation with the riding surface 29 the rear of the playfield 14 will be free to be upwardly lifted to, for example, remove the playfield 14 from the cabinet 12 once the wheels 34 are freed from the U-shaped stop 30. To move the playfield 14 from this fully open position towards the fully closed position the above described process is reversed and the front of the playfield 14 is first pulled forward where the forward motion becomes downward motion owing to the attachment with the support arm 38. During this downward motion, the wheels 34 move up the incline of brackets 28. As seen, in the closing process, the support arm 38 functions to guide the playfield 14 back to its seated position whereby any unwanted contact with the playfield cabinet 12 is avoided.

It should be apparent from the preceding description that this invention has among other advantages, the advantage of providing a playfield mounting assembly which allows the playfield to be easily and reliably lifted for exposing the components mounted thereunder.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

We claim:

1. A pinball machine, comprising:

a cabinet supporting a pair of cabinet brackets each having a riding surface;

a playfield disposed within said cabinet and movable therein between an open, intermediate, and closed position, said playfield supporting a pair of wheels each engageable with said riding surface of a corresponding one of said cabinet brackets; and at least one support arm pivotally linked to said cabinet at one end thereof and pivotally linked at the other end thereof to said playfield for guiding and supporting said playfield in movement between said positions.

2. The pinball machine as recited in claim 1, comprising a pair of support arms wherein each of said support arms is pivotally linked at one end thereof to said cabinet with the other end thereof being pivotally linked to said playfield.

3. The pinball machine as recited in claim 2, wherein at least one of said support arms has pivotally attached thereto a prop arm which prop arm is engageable with said playfield when said playfield is in said intermediate position.

4. The pinball machine as recited in claim 3, wherein said one of said support arms further comprises at least one post engageable with said prop arm for limiting rotational movement of said prop arm.

5. The pinball machine as recited in claim 2, wherein said playfield has attached thereto a pair of support brackets and wherein said support brackets are engageable with said riding surface of a corresponding one of said cabinet brackets when said playfield is positioned in said closed position.

6. The pinball machine as recited in claim 5, wherein each of said support arms is pivotally connected to a corresponding one of said support brackets.

7. The pinball machine as recited in claim 2, wherein each of said cabinet brackets includes a stop and wherein each of said wheels engages a corresponding one of said stops when said playfield is positioned in said open position.

8. The pinball machine as recited in claim 2, further comprising a catch secured to said playfield and engageable with one of said cabinet brackets for preventing said playfield from being removed from said cabinet.

9. The pinball machine as recited in claim 8, wherein said catch is pivotally linked to said playfield and wherein said catch is rotatably movable to a position which prevents engagement between said catch and said one of said cabinet brackets for allowing said playfield to be removed from said cabinet.

10. A pinball machine, comprising:

a game cabinet;

a playfield disposed with said cabinet and movable between open, intermediate, and closed positions; and a support assembly for maintaining said playfield within said cabinet, said support assembly comprising:

a pair of cabinet brackets mounted to said cabinet, each of said brackets having a riding surface;

a pair of wheels mounted to said playfield, each of said wheels being engageable with said riding surface of a corresponding one of said cabinet brackets;

a pair of support brackets connected to said playfield; and a pair of support arms each having one end thereof pivotally attached to said cabinet and the other end thereof pivotally attached to a corresponding one of said support brackets for guiding and supporting said playfield during movement between said positions;

wherein at least one of said support arms has pivotally attached thereto a prop arm which is engageable with said playfield when said playfield is disposed in said intermediate position.

11. The pinball machine as recited in claim 10, wherein each of said support brackets engages said riding surface of a corresponding one of said cabinet brackets when said playfield is disposed in said closed position.

12. The pinball machine as recited in claim 11, wherein said at least one of said support arms has at least one peg extending therefrom for limiting rotational movement of said prop arm.

13. The pinball machine as recited in claim 10, further comprising at least one catch linked to said playfield and engageable with one of said cabinet brackets for preventing removal of said playfield from said cabinet, said catch being further movable to a position wherein said catch will not engage said one of said cabinet brackets whereby said playfield will be freely removable from said cabinet.

14. A support assembly for use in movably maintaining a playfield within a pinball cabinet, comprising:

a pair of cabinet brackets, each having a riding surface, adapted to be mounted to said cabinet;

a pair of contacts adapted to be linked to said playfield and engageable with said riding surface of a corresponding one of said cabinet brackets; and a pair of support arms each having one end thereof adapted to be pivotally linked to said cabinet and the other end thereof adapted to be pivotally linked to said playfield for use in guiding and supporting movement of said playfield.

15. The support assembly as recited in claim 14, wherein said contacts each comprise a rotatable wheel assembly.

16. The support assembly as recited in claim 15, wherein at least one of said support arms further comprises a prop arm pivotally attached thereto and adapted to be engageable with said playfield.

17. The support assembly as recited in claim 16, wherein said at least one of said support arms includes at least one post for restricting rotational movement of said prop arm.

18. The support assembly as recited in claim 15, further comprising a catch assembly adapted to be linked to said playfield and engageable with one of said cabinet brackets for preventing removal of said playfield from said cabinet.

19. The support assembly as recited in claim 18, wherein said catch assembly is adapted to be rotatably linked to said playfield and wherein said catch assembly is movable to a position whereby said catch assembly will avoid contact with said one of said cabinet brackets whereby said playfield may be removed from said cabinet.

20. The support assembly as recited in claim 15, further comprising a pair of support brackets adapted to be mounted to said playfield each engageable with said riding surface of a corresponding one of said cabinet brackets.

21. The support assembly as recited in claim 20, wherein each of said support arms is pivotally connected to one of said support brackets.

* * * * *